US005682941A

United States Patent [19]

Oda et al.

[11] Patent Number: 5,682,941

[45] Date of Patent: Nov. 4, 1997

[54] DEVICE FOR PRODUCING MOLDS

[75] Inventors: Shigeo Oda, Toyokawa; Ryoji Kanayama, Toyohashi; Tadashi Nishida, Toyokawa, all of Japan

[73] Assignee: Sintokogio, Ltd., Japan

[21] Appl. No.: 569,583

[22] Filed: Dec. 8, 1995

[30] Foreign Application Priority Data

Dec. 9, 1994 [JP] Japan ..... 6-331482

[51] Int. Cl.[6] ..... B22C 15/02

[52] U.S. Cl. ..... 164/154.2; 164/154.8; 164/172

[58] Field of Search ..... 164/154.1, 154.2, 164/154.8, 172, 173, 207, 456, 37

[56] References Cited

U.S. PATENT DOCUMENTS

| | | | |
|---|---|---|---|
| 2,959,828 | 11/1960 | Frankenstein | 164/173 |
| 3,586,093 | 6/1971 | Young | 164/173 |
| 4,915,159 | 4/1990 | Damm et al. | 164/173 X |

FOREIGN PATENT DOCUMENTS

| | | | |
|---|---|---|---|
| 60-83742 | 5/1985 | Japan | 164/37 |
| 63-21577 | 5/1988 | Japan . | |
| 3-291127 | 12/1991 | Japan | 164/172 |
| 749545 | 7/1980 | U.S.S.R. | 164/173 |
| 973216 | 11/1982 | U.S.S.R. | 164/172 |
| 1722681 | 3/1992 | U.S.S.R. | 164/172 |

*Primary Examiner*—J. Reed Batten, Jr.

*Attorney, Agent, or Firm*—Limbach & Limbach LLP

[57] ABSTRACT

The includes a plurality of squeeze rods (12) and a squeeze plate (14) are used to press molding sand in a flask (16), and wherein the pressure applied to the individual squeeze rods and their individual downward movements are controlled. The device includes a squeeze table (2) on which a pattern plate (1) is mounted, a vertically movable frame (3) disposed above the squeeze table (2) such that the frame can move vertically relative to the squeeze table (2), a squeeze plate (14) mounted on a lower part of the vertically movable frame, a plurality of squeeze rods juxtaposed and penetrating the squeeze plate for vertical sliding movements, a plurality of electric servo-actuators attached to the frame to vertically move the squeeze rods, and a controller for controlling the plurality of the electric servo-actuators.

2 Claims, 6 Drawing Sheets

DEVICE FOR PRODUCING MOLDS

BACKGROUND OF THE INVENTION

1. Field of the Invention

This invention relates to a device to produce a mold by squeezing molding sand in a flask.

2. Description of the Prior Art

A conventional device is disclosed in Japanese Patent Publication (KOKOKU) No. 63-21577. It includes a squeeze plate disposed above a squeeze table which vertically carries a pattern plate attached to it. A plurality of fluid-type cylinders are juxtaposed and spaced suitably apart from each other above the pattern plate and directed downward such that the piston rods of the cylinders penetrate and vertically move through the squeeze plate.

However, such a conventional device has a problem in not being able to readily vary the pressure of the piston rods uniformly or differently, or control the distance for their downward movements within a short period when such variation or control is required to cope with the shape of the pattern on the pattern plate, the properties of the molding sand, or conditions of the molding sand fed into the flask.

SUMMARY OF THE INVENTION

This invention was made to overcome this problem. It aims to provide a device that can vary the pressure of the piston rods uniformly or differently, or control the distance for their downward movements to cope with the shape of the pattern on the pattern plate.

To achieve the purpose mentioned above the device of the present invention includes a squeeze table on which a pattern plate is mounted, a vertically movable frame disposed above the squeeze table for vertical movement relative to the squeeze table, a squeeze plate mounted on the vertically movable frame at a lower part thereof, a plurality of squeeze rods juxtaposed and adapted to penetrate the squeeze plate for vertical movement, a plurality of electric servo-actuators mounted on the vertically movable frame 3 to vertically move each of the squeeze rods 12, and a controller to control the plurality of servo-actuators.

In the device mentioned above the pressure and distance for downward movement, etc. of each squeeze rod, which correspond to the shape of the pattern plate, are predetermined, and data on the torque and angle of rotation of each servomotor, which correspond to the predetermined pressure and distance of each squeeze rod, are stored in the controller. Further, all the servomotors are reversely driven to raise all the squeeze rods. After the rods are raised, molding sand is fed into a flask mounted on the pattern plate, and the device is then operated. Thereupon, the squeeze plate and other parts are lowered via the frame, and the squeeze plate comes into contact with the upper surface of the molding sand in the flask. The servomotors are then driven by the instructions of the controller to lower the squeeze rods corresponding to the shape of the pattern plate wherein their pressures and distances to be moved downward are controlled. Thus the molding sand is compressed part-by-part. All the servomotors are then reversely driven to raise all the squeeze rods. After this, the squeeze plate and other parts are lowered via the frame, thus all the molding sand being compressed. The pressure of the squeeze rods can be varied by changing, via the controller, the torque instructions to the servomotors.

DESCRIPTION OF THE PREFERRED EMBODIMENT

Figure 1:
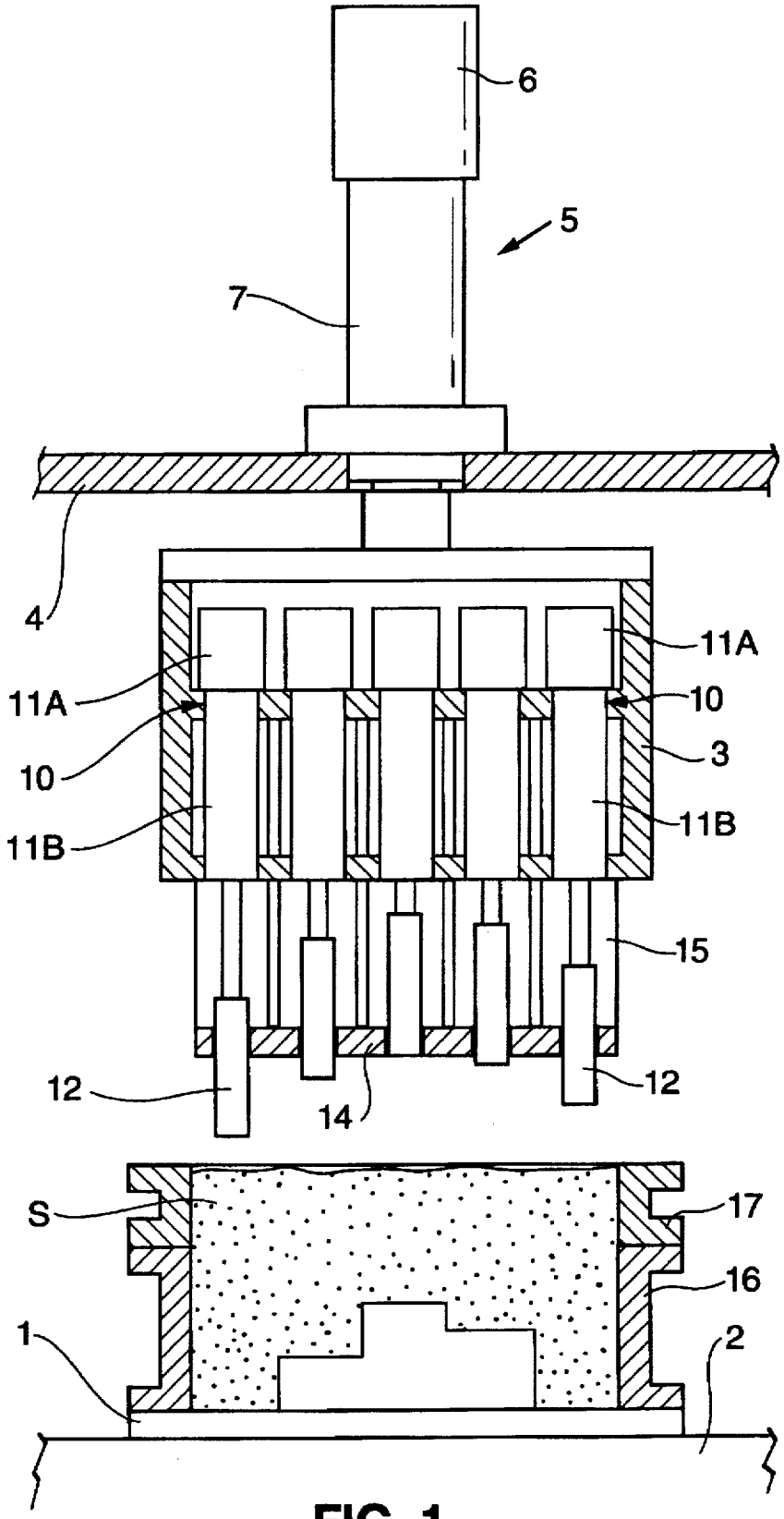
FIG. 1 is a partially fragmentary sectional front view of the main part of an embodiment of the mold-producing device of the invention.

An embodiment will now be explained by referring to FIGS. 1 to 6. A vertical movable frame 3 is disposed above a squeeze table 2 on which a pattern plate 1 is mounted. The frame 3 is mounted on the ceiling of a gate frame 4 for vertical movement caused by an electrical cylinder 5 which faces downward and which acts as an electric actuator. The electrical cylinder 5 includes a servomotor 6 provided with a rotary encoder (not shown), and a rotational movement conversion device 7 such as a ball screw, which converts the rotational movement of the output shaft of the servomotor 6 to a linear one. A controller 9 is electrically connected to the servomotor 6 via a driver 8 (see FIG. 2). Since the controller 9 is provided with a microcomputer (not shown), it can store all the data on the torques and angles of rotation of the servomotor 6.

Further, as in FIG. 1, a plurality of electric cylinders 10, acting as electric actuators, are juxtaposed and mounted on the inside and on the upper part of the vertically movable frame 3. Each electrical cylinder 10 has a servomotor **11*a* provided with a rotary encoder (not shown), and a ball screw 11*b* which is connected to the output shaft of the servomotor 11*a* so as to convert the rotational motion of the output shaft of the servomotor to the linear motion of the output screw rod of the ball screw. A vertical squeeze rod 12 is attached to the output screw rod of each ball screw 11*b*. The rod 12 penetrates a squeeze plate 14 and can be moved up or down by rotating the servomotor 11*a* in either direction. Further, when the squeeze rods 12 are moved up, the level of their lower ends is substantially equal to that of the lower surface of the squeeze plate 14. The squeeze plate 14 through which the squeeze rods 12 slidably pass is attached to the vertically movable frame 3 through a supporting member 15. Numerals 16 and 17 in FIG. 1** respectively designate a molding flask and a filling frame disposed on it.

Figure 2:
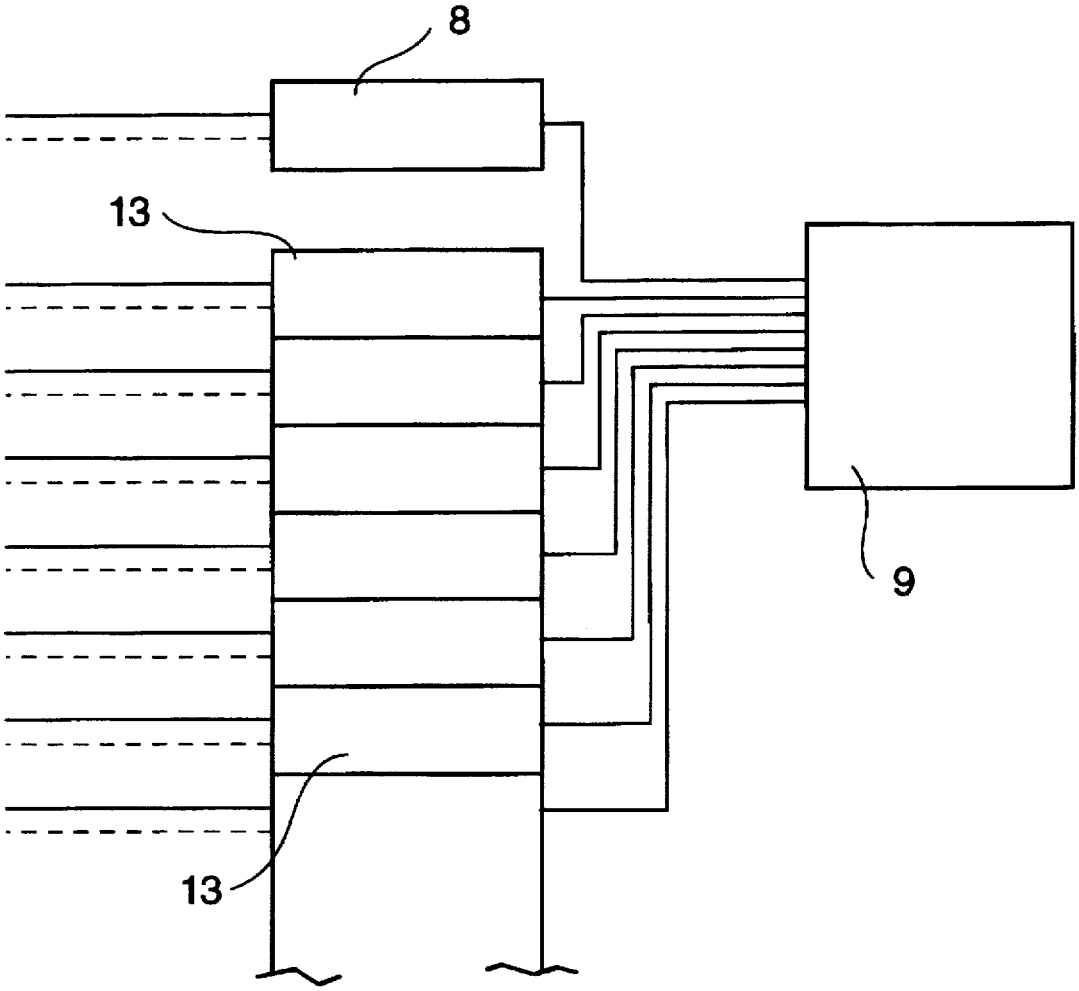
FIG. 2 is a block diagram for the electrical control of the servomotors used in the device.

Further, as in FIG. 2, the controller 9 is electrically connected to the servomotors **11*a* through drivers 13, and the microcomputer (not shown) of the controller 9 can store data on the torques and the angles of rotation of the servomotors 11*a***.

Figure 3:
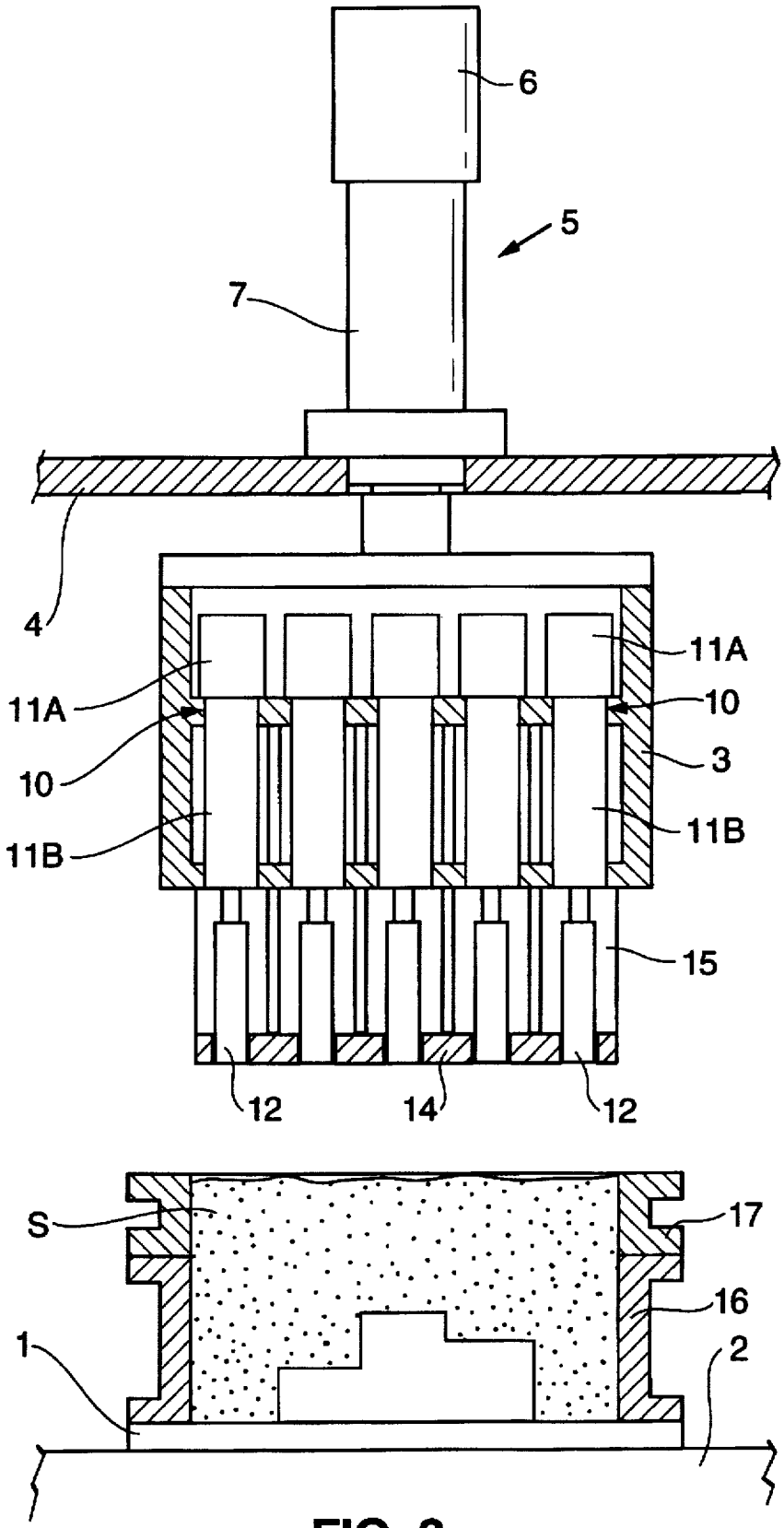
FIG. 3 is a partially fragmentary sectional front view like FIG. 1, wherein the squeeze rods and plate of the device are in their initial positions to explain the operation of the embodiment.
Figure 4:
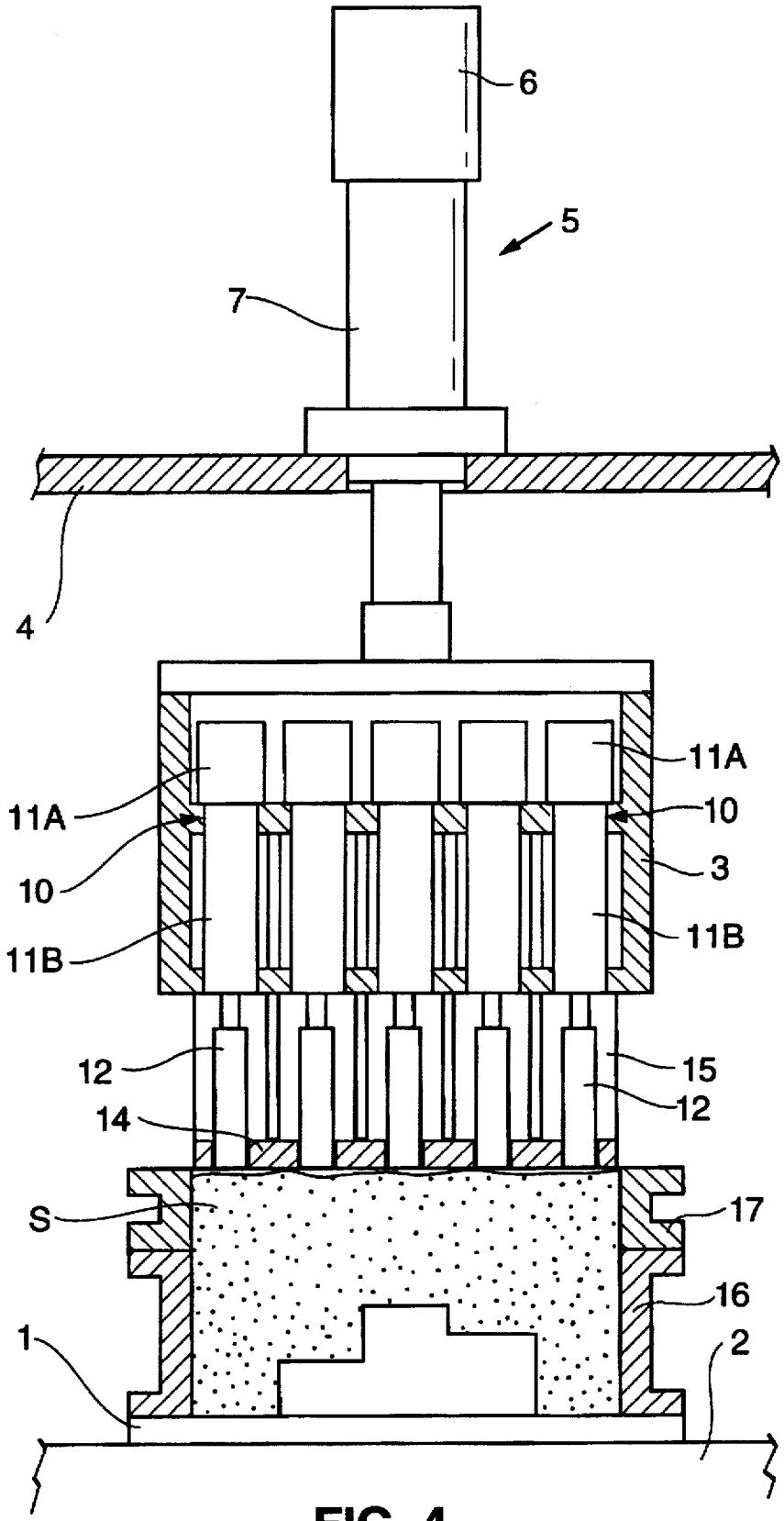
FIG. 4 is a partially fragmentary sectional front view like FIG. 3, wherein the squeeze rods and plate are moved to the surface of the molding sand.

The operation of the device of the invention to produce molds will now be explained. The pressure applied to individual squeeze rods 12 and their distances for downward movements are predetermined, so that the pressure and distances of the rods 12 correspond to the shape, or profile, of the pattern plate 1. The torques and angles of rotation of the servomotors **11*a*, which correspond to the predetermined pressures and distances, are predetermined, and then data on them is stored in the microcomputer (not shown) of the controller 9. Further, the servomotors 11***a* are reversely driven to move the squeeze rods 12 up to the upper dead point. This state is shown in FIG. 3. Then, molding sand S is fed into the molding flask 16, which is placed on the pattern plate 1, and the filling frame 17, and the device is driven. Accordingly, the rod of the electric cylinder advances to move the squeeze plate 14 and its associated members via the frame 3, and the squeeze plate 14 comes into contact with the upper surface of the molding sand of the filling frame 17 (see FIG. 4). All the servomotors 11*a* are then driven based on the instructions of the controller 9 via the drivers 13.

Figure 5:
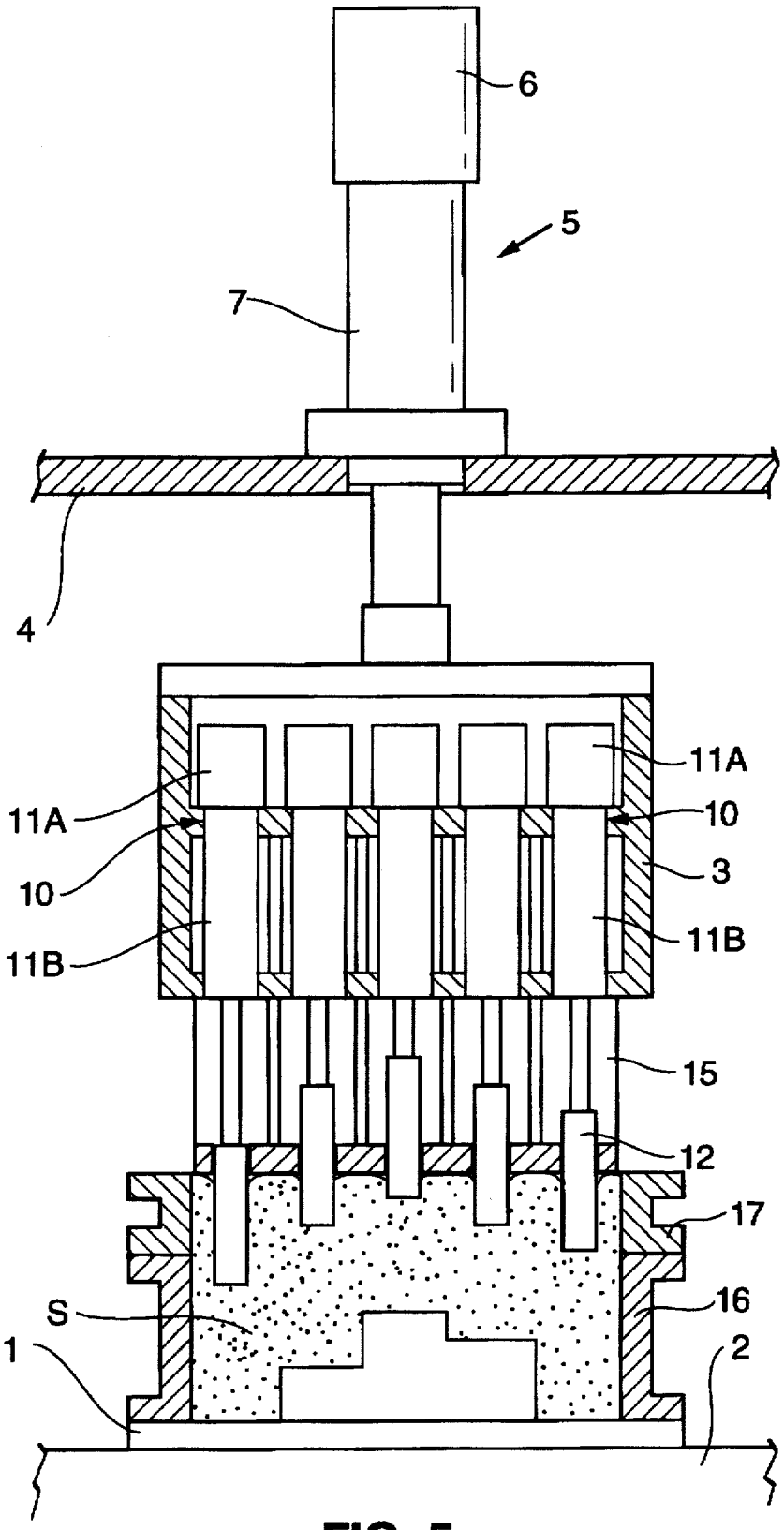
FIG. 5 is a partially fragmentary sectional front view like FIG. 4, but the squeeze rods are pressed further into the molding sand.
Figure 6:
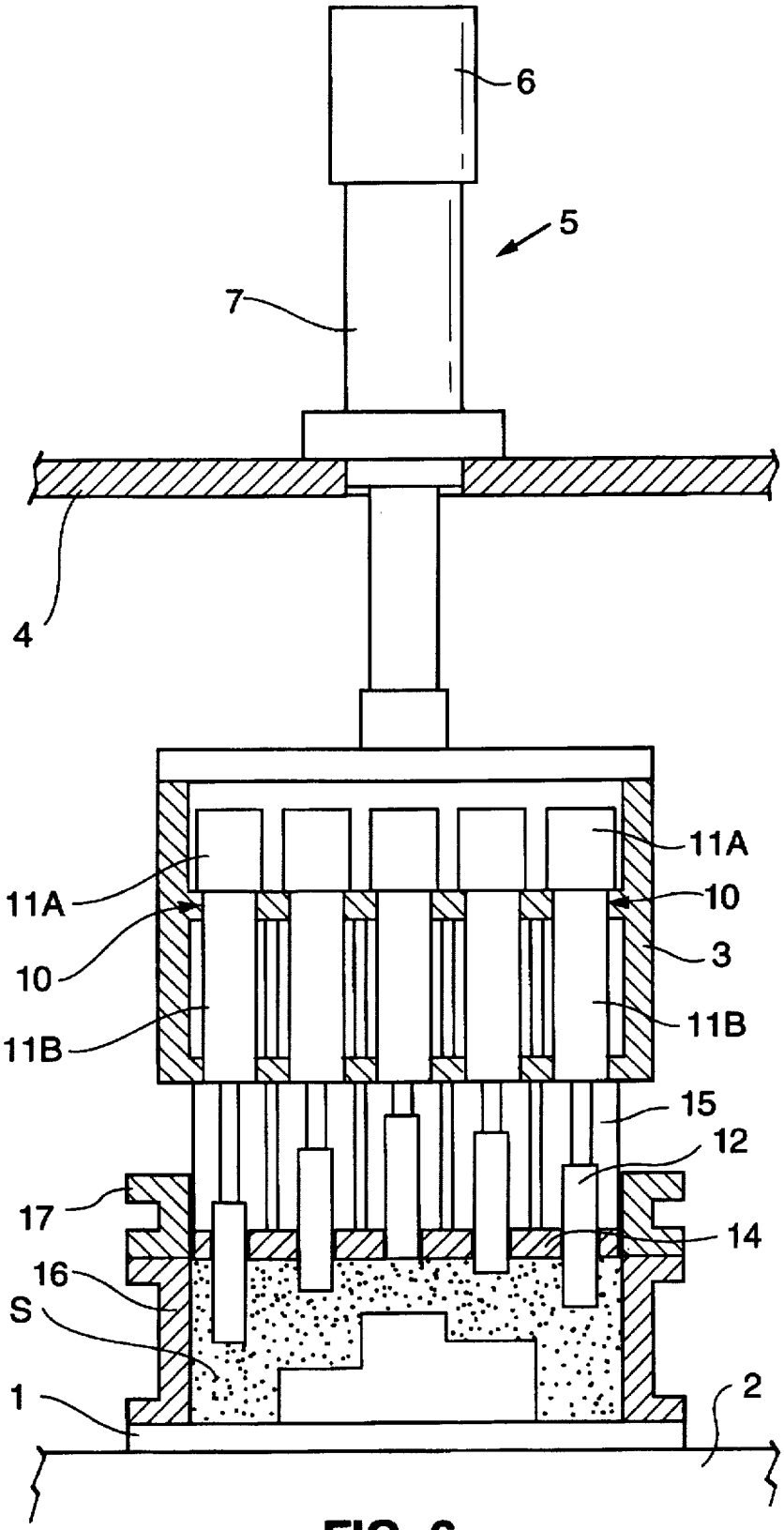
FIG. 6 a partially fragmentary sectional front view of the device, wherein the molding sand is pressed in a way different from that in FIGS. 3, 4, and 5.

Thus, as in FIG. 5, the individual squeeze rods 12 are lowered to levels corresponding to the profile of the pattern of the pattern plate 1, wherein the pressure given to the rods 12 is controlled, thereby compressing the molding sand S part-by-part. Then, all servomotors 11*a* are reversely driven to raise all the squeeze rods 12. The electrical cylinder 5 is then advanced to further lower the squeeze plate 14, thereby squeezing all the molding sand S.

After the compression of the molding sand S is completed, the electric cylinder is retracted to move the flame 3 and the other members up. The flask 16 and frame 17 are then moved up by any known way for their removal.

Although in the embodiment mentioned above the squeeze plate 14 is lowered to press the molding sand S, the pattern plate 1, etc. may instead be moved up by raising the squeeze table 2 to squeeze the molding sand S.

Also, in the embodiment, first the squeeze plate 14 is lowered to the upper surface of the molding sand S, the squeeze rods 12 are then lowered to squeeze the molding sand S part-by-part, and finally the squeeze plate 14 is lowered to squeeze all the molding sand S. However, this way may be substituted by an embodiment where data on the output force of the cylinder rod of the electric cylinder 5 and the angles of rotation of the servomotors 11*a* is stored in the controller 9, and in operation the squeeze rods 12 are first lowered to their individual levels below the squeeze plate 14, and then the electric cylinder is advanced to move the frame 3 downward, thereby squeezing the molding sand S by the squeeze rods 12 and the squeeze plate 14 at the same time (see FIG. 6).

Further, in the embodiment mentioned above electrical cylinders having ball screws 7, 11*b* are used as electric actuators. However, this invention is not limited to this, and other mechanisms may also be used. For example, endless roller chains may be rotated by servomotors 6, 11*a* to move the frame 3 and squeeze rods 12 up and down. Again, electric cylinders having linear motors may also be used.

As is seen from the above description, the device of the invention includes a squeeze table on which a pattern plate is mounted, a vertically movable frame disposed above the squeeze table such that the frame can move vertically relative to the squeeze table 2, a squeeze plate 14 mounted on a lower part of the vertically movable flame, a plurality of squeeze rods juxtaposed and penetrating the squeeze plate for vertical sliding movement, a plurality of electric servo-actuators attached to the frame to vertically move the squeeze rods, and a controller for controlling the plurality of the electric servo-actuators. Thus the device has excellent advantages in that the individual pressure of the squeeze rods can be varied uniformly or differently, and in that the distance of the downward movement of each rod can be controlled.

What we claim is:

1. A device for producing molds, comprising:

a squeeze table (2) on which a pattern plate (1) is mounted;

a vertically movable frame (3) disposed above the squeeze table such that the frame can move vertically relative to the squeeze table;

a squeeze plate (14) mounted on a lower part of the frame;

a plurality of squeeze rods (12) juxtaposed and penetrating the squeeze plate for vertical sliding movements;

a plurality of electric servo-actuators (10) attached to the frame to vertically move the squeeze rods; and a controller (9) for controlling each of the plurality of electric servo-actuators.

2. A device for producing molds, comprising:

a frame (3) disposed above a squeeze table on which a pattern plate is attached;

means (5) for vertically moving the frame relative to the squeeze table;

a squeeze plate (14) mounted on a lower part of the frame;

a plurality of squeeze rods (12) juxtaposed and penetrating the squeeze plate for vertical sliding movements;

a plurality of electric servo-actuators (10) attached to the frame to vertically move the squeeze rods; and a controller (9) for controlling each of the plurality of electric servo-actuators.

* * * * *